United States Patent [19]

Merkel

[11] 4,208,817

[45] Jun. 24, 1980

[54] ROUTER BIT ASSEMBLY FOR AN EARTH WORKING APPARATUS

[75] Inventor: Russell D. Merkel, Coal City, Ill.

[73] Assignee: Caterpillar Tractor Co., Peoria, Ill.

[21] Appl. No.: 30,244

[22] Filed: Feb. 15, 1979

[86] PCT No.: PCT/US79/00090

§ 371 Date: Feb. 15, 1979

§ 102(e) Date: Feb. 15, 1979

[51] Int. Cl.[2] ..... E02F 9/28

[52] U.S. Cl. ..... 37/141 T; 37/DIG. 12; 172/702; 172/777; 403/408

[58] Field of Search ..... 172/777, 778, 752, 753, 172/719, 763, 702, 749; 403/408, 388, 390; 37/141 R, 141 T, DIG. 12

[56] References Cited

U.S. PATENT DOCUMENTS

| | | | |
|---|---|---|---|
| 2,831,275 | 4/1958 | Kimsey et al. | 37/141 T |
| 3,032,901 | 5/1962 | Dils, Jr. | 37/141 R |
| 3,088,232 | 5/1963 | Gilbertson | 37/141 R |
| 3,456,370 | 7/1969 | Gilbertson | 37/141 R |
| 3,465,833 | 9/1969 | Lutz | 172/719 |
| 3,643,357 | 2/1972 | Benning et al. | 37/141 R |
| 3,961,788 | 6/1976 | Helton et al. | 37/141 T X |
| 4,007,550 | 2/1977 | Stepe | 172/777 X |

*Primary Examiner*—Clifford D. Crowder

*Attorney, Agent, or Firm*—Wegner, Stellman, McCord, Wiles & Wood

[57] ABSTRACT

A router bit assembly for an earth working apparatus (10, 12) including earth working means having a generally horizontally elongated blade (18) with a generally vertically extending side member (22) at least one end of the blade, a relatively tall router bit (32) formed of plate metal extending along the side member and in proximity to the blade, a relatively short support (34) for the router bit interposed between the router bit and the side member and having a first lip (36) overlying and substantially abutting the upper extremity (38) of the router bit and a second lip (40) underlying the lower extremity (30) of the side member, and removable bolts (50) securing the router bit and the support to the side member.

5 Claims, 5 Drawing Figures

10
12
14
16
18
20
22
30
32
36
52
54
60
64
66
70
76
78
80
82

ROUTER BIT ASSEMBLY FOR AN EARTH WORKING APPARATUS

DESCRIPTION

Technical Field

This invention relates to a router bit assembly for earth working apparatus as, for example, a tractor scraper, a bucket loader, a dozer, etc.

Background Art

The most pertinent prior art known to the applicant is U.S. Pat. No. 2,831,275 issued Apr. 22, 1958 to Kimsey et al. Other prior art of possible relevance includes the following U.S. Pat. No. 3,032,901 issued May 8, 1962 to Dils; U.S. Pat. No. 3,088,232 issued May 7, 1963 to Gilbertson; U.S. Pat. No. 3,456,370 issued July 22, 1969 to Gilbertson; U.S. Pat. No. 3,465,833 issued Sept. 9, 1969 to Lutz; and U.S. Pat. No. 3,643,357 issued Feb. 22, 1972 to Benning et al.

In most earth working vehicles, there is provided a transverse, or horizntally elongated cutting edge for the purpose of cutting into the underlying terrain. In addition to the transverse cutting edge, it is desirable to provide short cutting edges on opposite ends of the transverse edge to act as leading edges at the lower parts of vertically extending sides of the earth working implement. These cutting edges are commonly known as router bits and they are provided to slice through the earth as the implement is being moved forwardly to insure a clean cut and to protect lower leading edges of the side members. If not provided, the lower extremities of the side members wear at excessive rates necessitating frequent time consuming and expensive repair.

Thus, for a considerable period of time, the assignee of the present application has utilized router bits of the type disclosed in the above identified Kimsey et al patent in apparatus where their desirability is apparent as, for example, tractor scrapers. While such router bits have worked well for their intended purpose and, are relatively long lived because of their reversability, they are not altogether satisfactory from an economic point of view. The Kimsey et al router bits are formed of forgings which are relatively expensive to fabricate and which must be discarded when worn out. And, because one side of the Kimsey et al router bit, which is configured with flanges to provide for reversability, is drawn through the earth during use, some wear to such flanges will inevitably occur. When such wear is excessive, it may become difficult to reverse the router bit and remount it due to the wear on the flanges. Such wear can also result in a relatively loose fit with the consequence that vertical shear stresses are placed upon the means, i.e. bolts, used by Kimsey et al to secure the router bits in place.

DISCLOSURE OF INVENTION

The present invention is directed to overcoming one of more of the above problems.

According to the present invention, there is provided a router bit assembly for an earth working apparatus including earth working means having a generally horizontally elongated blade with a generally vertically extending side member at at least one end of the blade. A relatively tall router bit formed of plate metal extends along the side member and in proximity to the blade. A relatively short support is provided for the router bit and is interposed between the router bit and the side member. The support has a first lip overlying and substantially abutting the upper extremity of the router bit and a second lip underlying the lower extremity of the side member. Removable means secure the router bit and the support to the side member.

As a consequence of this construction, the router bit may be formed of inexpensive plate metal as opposed to expensive forgings. The relative dimensioning of the router bit and its support minimizes wear of the support to provide it with a long life thereby making it economically feasible to form the support of a forging. Because the support is not subjected to wear, vertical shear stresses in the securing means are eliminated through direct transmission from the router bit to the side member via the support.

Other objects and advantages will become apparent from the following specification taken in connection with the accompanying drawings.

BEST MODE FOR CARRYING OUT THE INVENTION

Figures 1, 2:
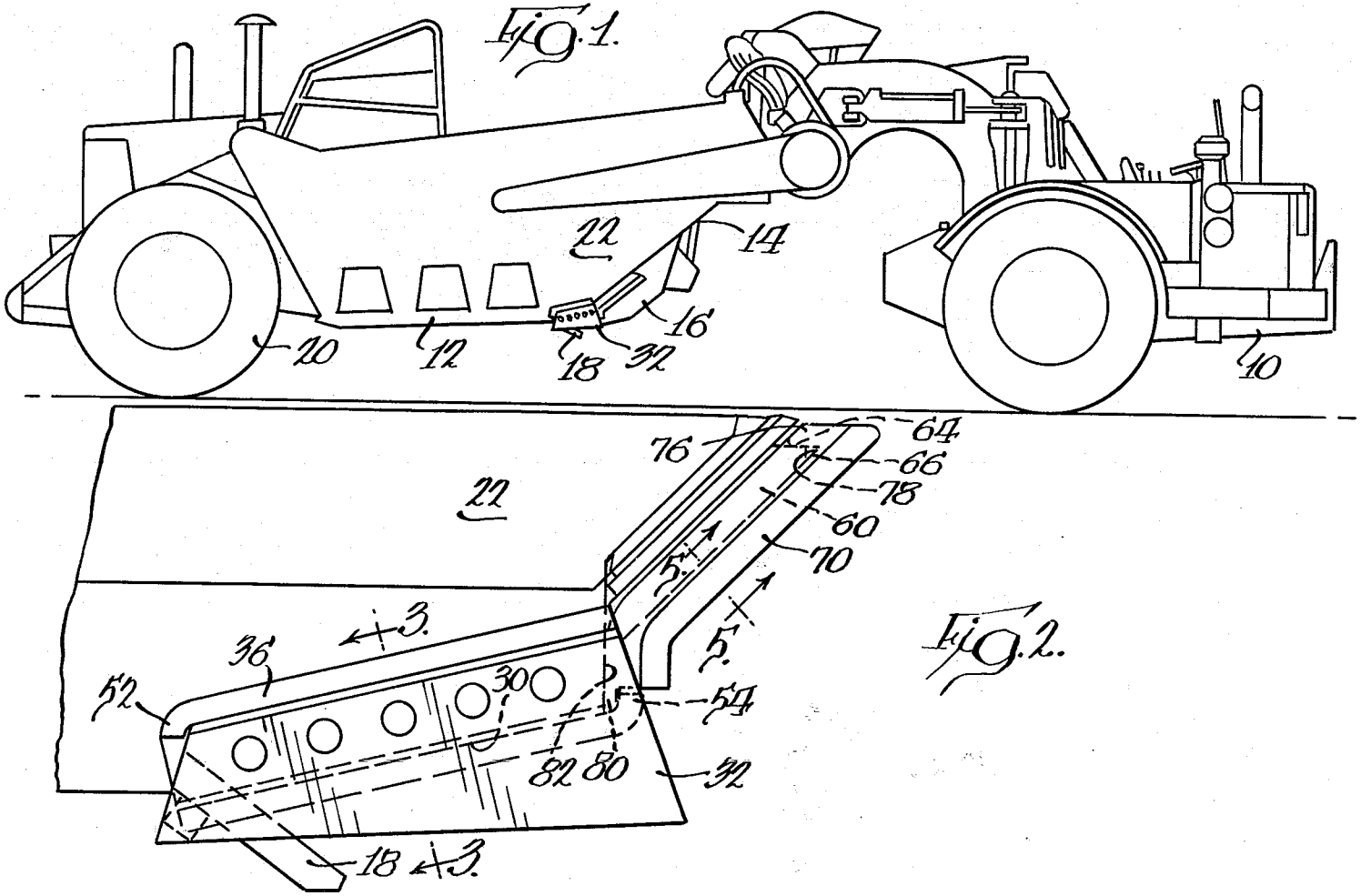
FIG. 1 is a side elevation of an earth working apparatus, namely, a tractor scraper, employing an embodiment of the present invention.
FIG. 2 is an enlarged, fragmentary, side elevation of the router bit assembly.

One embodiment of a router bit assembly made according to the invention is illustrated in FIG. 1 in the environment of a tractor scraper. However, it will be understood that the invention is not limited to use in such an environment but may be employed with efficacy in a variety of earth working apparatus as, for example, dozers, bucket loaders, etc. The earth working apparatus includes a tractor 10 and a trailing scraper bowl 12. The forward end 14 of the scraper bowl 12 may be closed by an apron 16 or opened as desired. The lower edge of the bowl 12 at the forward end 14 is provided with a horizontally elongated scraper blade 18 which can be engaged with the underlying terrain by lowering the bowl 12 about a pivot axis defined by the centers of its rear wheels 20 in a conventional fashion.

The bowl 12 has upstanding side walls 22 and, as is well known, the blade 18 extends between the walls 22.

Figure 3:
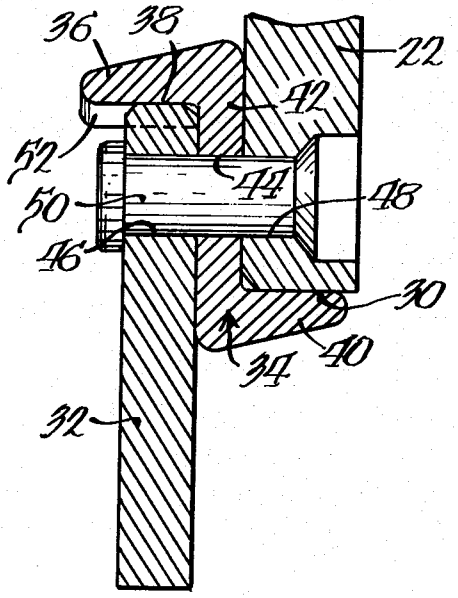
FIG. 3 is an enlarged, fragmentary sectional view taken approximately along the line 3—3 in FIG. 2.

Referring to FIGS. 2 and 3, each side wall 22, near the forward end 14 of the bowl, has a slightly upwardly inclined, downwardly facing lower edge 30. Along the length of the edge 30, on each of the side walls 22, a router bit 32 of any desired configuration is provided. According to the invention, the router bit 32 is formed of metal plate, such as steel plate, as opposed to being a cast or forged member. Consequently, the router bit 32 is relatively inexpensive.

A support, generally designated 34, is employed to secure the router bit 32 to the side wall 22 at the lower edge 30 and as can be seen in FIGS. 2 and 3, the support 34 includes a first, elongated lip 36 which overlies and abuts the upper extremity 38 of the router bit 32 along its length. A second lip 40 extends along the length of the support 34 and projects oppositely from the lip 36 to underlie the edge 30 of the side wall 22. As seen in FIG. 3, the lips 36 and 40 are spaced from each other and are interconnected by a web 42 to result in a Z-shaped cross section.

Figure 4:
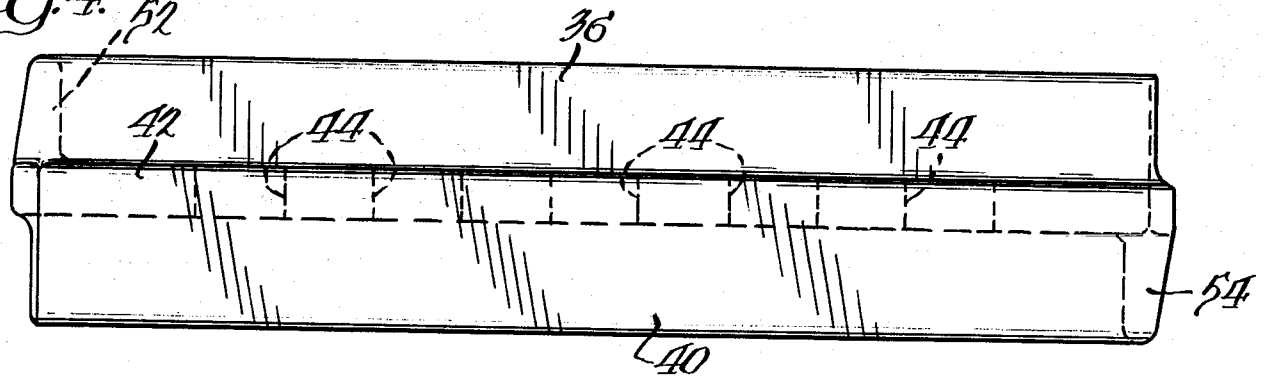
FIG. 4 is a plan view of a support employed in the assembly.

As seen in FIGS. 2, 3 and 4, the web 42 is provided with a series of bolt holes 44. Similarly aligned bolt holes 46 are provided in the router bit 32 while aligned bolt holes 48 are provided in the side wall 22. Suitable bolts or the like 50 extend through aligned ones of the bolt holes 44, 46, and 48 so that the router bit 32 can be joined to the side wall 22 via the support member 34.

It will be observed from FIG. 3 that the support 34 is relatively short while the router bit 32 is relatively tall. Thus, the support 34 is somewhat spaced from the working edges of the router bit 32 and accordingly, will not be subjected to the wear imparting forces that occur thereat through contact with the earth.

As seen in FIGS. 2, 3 and 4, the first lip 36, at its rearwardmost end, that is, the end in the direction away from the working edge of the blade 18, includes a downturned portion or section 52 which extends behind the rearwardmost extremity of the router bit 32. The second lip 40 includes an upturned section 54 which is located forwardly of the forwardmost edge of the side wall 32.

From a consideration of the orientation of the lips 36 and 40 with respect to the web 42, the apertures 44 therein, and the downturned portion 52 and the upturned portion 54, it will be appreciated that each support 34 is completely reversable. By completely reversable it is meant that by rotating the support 34 180° about its longitudinal axis as well as rotating the same 180° about the axis of the centermost bolt hole 44, the second lip 40 can be made to perform the function of the first lip 36 and vice versa. At the same time, simply by rotating the support 34 180° about the axis of the centermost bolt hole 44, it can be applied to the opposite side wall 22 of the bowl 12.

Returning to FIG. 2, the forward edge 14 of the side wall 22 may be provided with a narrow forwardly projecting retaining strip 60 (see also FIG. 5) secured in place as by welding 62. The upper end of the retaining strip 60 includes two converging surfaces 64 and 66 which define a projection.

Figure 5:
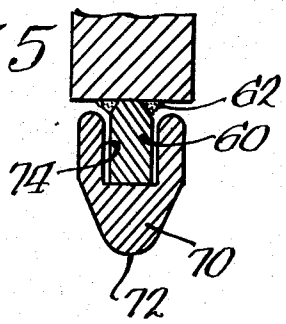
FIG. 5 is a sectional view taken along the line 5—5 in FIG. 2.

An elongated wear member 70 is releasably secured to the strip 60 without the need for auxiliary fasteners. As seen in FIG. 5, the wear member 70 includes a fowardly facing nose 72 and an opposite, rearwardly opening groove 74 which receives the retaining strip 60. At its upper end, the wear member 70 includes a rearwardly directed section 76 which, together with a part of the groove 74, defines a hooklike cavity 78.

The lower end of the wear member 70 includes a small, downwardly extending tongue 80. The tongue 80 is received between a part 82 of the forward end of the side wall 22 and the upturned section 54 of the second lip 40.

To install the wear member 70, the same is disposed on the retaining strip 60 such that the projection defined by the converging surfaces 64 and 66 enters the cavity 78. Thereafter, the support member 34 may be installed to capture the wear member 70 with the tab 80 behind the upturned section 54.

INDUSTRIAL APPLICABILITY

The present invention allows the use of inexpensive material in forming the router bit 32. At the same time, the support 34, is subject to minimum wear and, as wear does occur, it will not occur on the supporting surfaces of the support 34, that is, the surface intended to abut the edge 30 or the extremity 38 of the router bit 32. Consequently, all vertical loading imparted to the router bit 32 is directly transmitted to the side wall 22 via the support 34 and not through the bolts 50. The reversability of the support 34 provides for great flexibility in its use and the unique construction allows simple installation of a vertical wear member 70 without the need for the use of bolts or the provision of bolt receiving apertures therefor during manufacturing operations.

I claim:

1. A router bit assembly for an earth working apparatus (10,12) comprising:

earthworking means including a generally (18) horizontally elongated blade with a generally vertically extending side member (22) at at least one end of the blade;

a router bit (32) formed of plate metal extending along said side member and in proximity to said blade;

a support (34) for said router bit interposed between said router bit and said side member and having a first lip (36) overlying and substantially abutting the upper extremity (38) of said router bit and a second lip (40) underlying the lower extremity (30) of said side member; and removable means (50) securing said router bit and said support to said side member.

2. The router bit assembly of claim 1 wherein said support is Z-shaped in cross-section.

3. The router bit assembly of claim 2 wherein said first lip, at its end in a direction away from the blade, includes a down turned section (52) behind the corresponding extremity of said router bit and said second lip, at its end remote from said first lip end, includes an upturned section (54) in front of said side member.

4. The router bit assembly of claim 3 wherein said removable means comprise bolts (50) and there are a plurality of bolt holes (44) in said support member centered between said lips, said support means being reversible.

5. The router bit assembly of claim 3 wherein said front of said side member includes a narrowed, vertically extending retaining strip (60) terminating in a projection (64,66) and futher including an elongated wear member (70) having a slot (74) receiving said strip, a hook (76,78) on one end disposed on said projection, and its opposite end (80) disposed between said side member and said upturned section of said second lip.

* * * * *